United States Patent [19]

Thomas

[11] Patent Number: 4,504,240

[45] Date of Patent: Mar. 12, 1985

[54] HAND PUPPET WITH DETACHABLE FACIAL ELEMENTS

[75] Inventor: John J. Thomas, North Olmsted, Ohio

[73] Assignee: American Greetings Corporation, Cleveland, Ohio

[21] Appl. No.: 419,720

[22] Filed: Sep. 20, 1982

[51] Int. Cl.[3] ..... A63H 3/16

[52] U.S. Cl. ..... 446/100; 446/327

[58] Field of Search ..... 46/154, 156, 158, 151, 46/135 R, 22, 142, DIG. 1, 115; 446/99–101, 321, 327, 329, 337, 395

[56] References Cited

U.S. PATENT DOCUMENTS

| | | | |
|---|---|---|---|
| 2,261,328 | 11/1941 | Baum | 46/164 |
| 2,619,771 | 12/1952 | Jones | 46/154 |
| 2,762,163 | 9/1956 | Stein | 46/156 |
| 2,929,170 | 3/1960 | Brown et al. | 46/154 |
| 2,932,125 | 4/1960 | McAllister | 46/135 R |
| 3,032,922 | 5/1962 | Mitchell | 46/154 |
| 3,034,255 | 5/1962 | Bacon | 46/152 |
| 3,210,884 | 9/1965 | Sharff et al. | 46/164 |
| 3,520,078 | 7/1970 | Klamer | 46/22 |
| 4,054,006 | 10/1977 | Estlund | 46/154 |
| 4,122,628 | 10/1978 | Crowell et al. | 46/135 R |
| 4,197,670 | 4/1980 | Cox | 46/151 |
| 4,208,832 | 6/1980 | Corriveau | 46/22 |
| 4,288,222 | 9/1981 | Kling | 46/162 |

FOREIGN PATENT DOCUMENTS

| | | | |
|---|---|---|---|
| 813456 | 5/1959 | United Kingdom | 46/154 |

OTHER PUBLICATIONS

Sear's Catalogue Item No. 49N36044 entitled "Hugo can be anything".

*Primary Examiner*—M. Yu

*Attorney, Agent, or Firm*—Maky, Renner, Otto & Boisselle

[57] ABSTRACT

A hand puppet in which a plurality of different facial components can be removably attached to a head portion to produce different characters, such as monsters, funny looking characters, science fiction characters, etc. The hand puppet has a relatively rigid head portion, and the facial components can be attached anywhere on the head portion, and in any orientation relative to the head portion. A sleeve depends from the head portion, and has an opening at its distal end, and into which an operator's hand can be inserted to support the puppet.

The sleeve is preferably formed of fabric which depicts an outer garment for the puppet and the sleeve has a pocket for storing the detachable facial components. Further, the sleeve is designed so that when the pocket is closed, it is basically hidden from view. Thus, the detachable facial components that are not being used to form the puppet's face are stored in a way which does not detract from the appearance of the puppet, and yet makes them readily accessible for changing the puppet's face.

5 Claims, 6 Drawing Figures

HAND PUPPET WITH DETACHABLE FACIAL ELEMENTS

BACKGROUND AND SUMMARY OF THE INVENTION

The present invention relates to a hand puppet in which a plurality of different facial components can be removably attached to a head portion to produce different characters, such as monsters, funny looking characters, science fiction characters, etc.

The hand puppet of the invention has a relatively rigid head portion, and the facial components can be attached anywhere on the head portion, and in any orientation relative to the head portion. According to the preferred embodiment, the head portion has a relatively rigid base, and that base is covered with a layer of material which can detachably engage "Velcro"-type material. Each of the plurality of facial components has a layer of "Velcro"-type material thereon, and that material allows the components to be attached anywhere on the head portion, and in any orientation relative to the head portion.

A sleeve depends from the head portion, and has an opening at its distal end, and into which an operator's hand can be inserted to support the puppet. The sleeve is preferably formed of fabric which depicts an outer garmet for the puppet and the sleeve has a pocket for storing the detachable facial components. Further, the sleeve is designed so that when the pocket is closed, it is basically hidden from view. Thus, the detachable facial components that are not being used to form the puppet's face are stored in a way which does not detract from the appearance of the puppet, and yet makes them readily accessible for changing the puppet's face.

The puppet of the invention lends itself to forming a variety of different characters, at the whim of an individual. A character can be changed by completely changing the facial components which are attached to the head portion. Further, a character's face can be changed by adding to, or subtracting from, the facial components which form that character's face. Still further, a character's face can be changed by rearranging the orientation of the components which form the character's face.

BRIEF DESCRIPTION OF THE DRAWINGS

The invention will become more apparent from the following description of the preferred embodiment with reference to the accompanying drawings wherein.

DESCRIPTION OF THE PREFERRED EMBODIMENT

Figure 1:
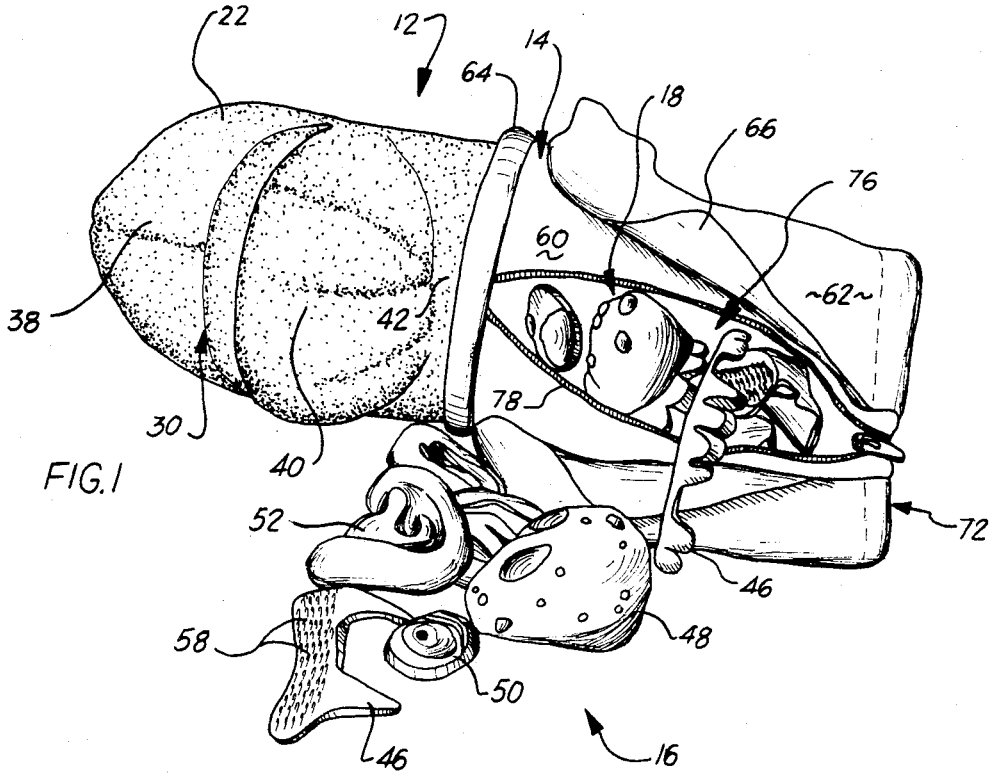
FIG. 1 is a perspective view of the elements for forming a hand puppet according to the invention.

FIG. 1 illustrates the basic components of a hand puppet according to the present invention. The components include a head portion 12, a fabric sleeve 14 depending from the head portion 12, and a plurality of detachable facial components 16 which can be stored in a pocket 18 formed in the fabric sleeve, and which are attached to the head portion 12 to form the puppet's face.

Figure 5:
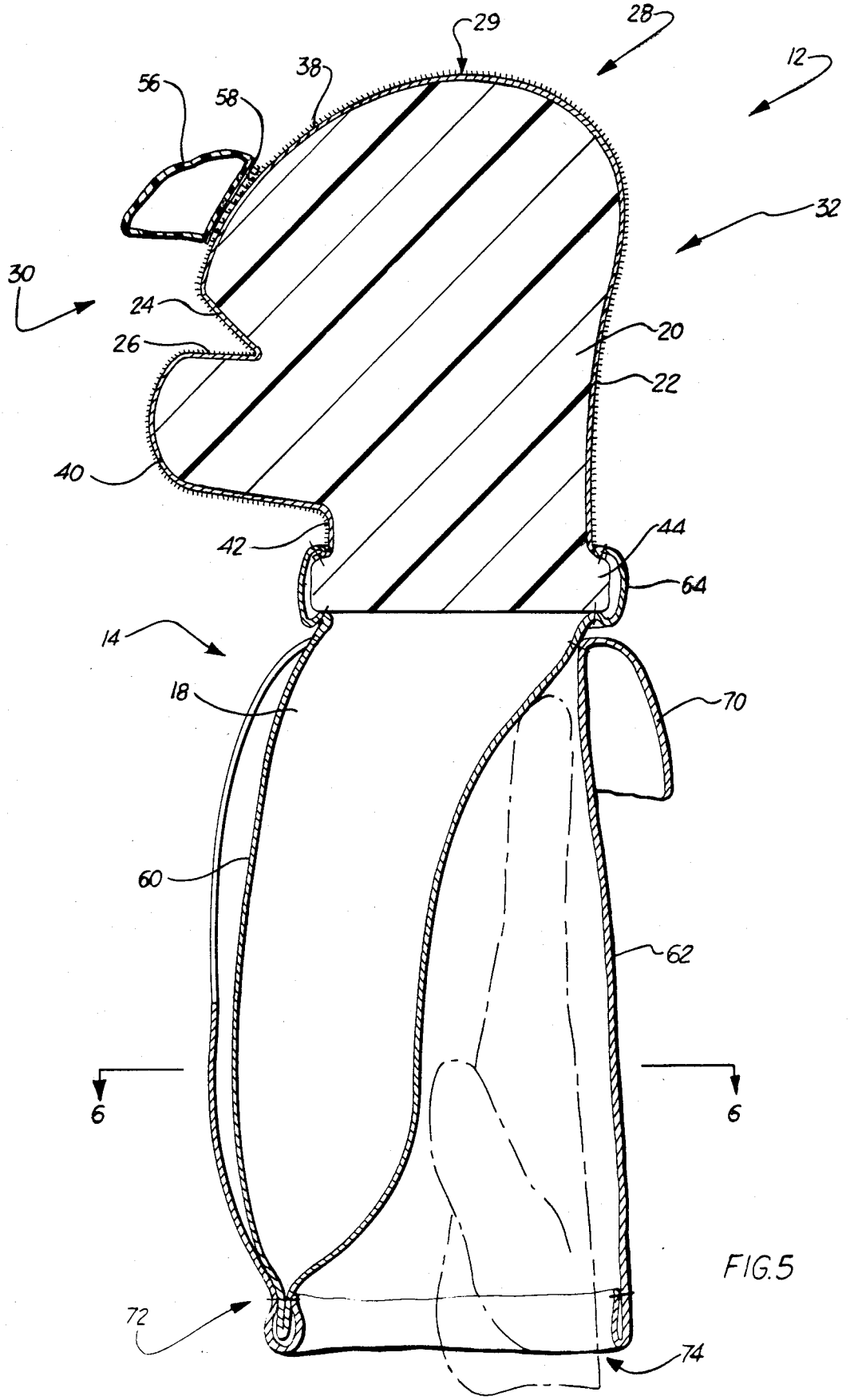
FIG. 5 is a sectional view of the puppet of FIG. 2, taken from the direction 5—5 with parts omitted.

The head portion 12 has a relatively stiff base 20 (FIG. 5), preferably formed of a urethane foam, and a layer of polyester material 22 covering the entire base 20. The polyester material is of a type which readily engages "Velcro"-type material. Together, the base 20 and the layer of polyester material 22 form a head portion with (i) a top area 28, (ii) a front area 30, (iii) a back area 32 and (iv) a pair of side areas 34, 36 extending between the front and back areas. In the front area 30, the head portion has a pair of diverging surfaces 24, 26 which define a mouth, and a forehead 38 and a chin 40 disposed on opposite sides of the mouth. Further, the base 20 defines a neck area 42 and an annular flange 44.

The detachable facial components 16 include a wide assortment of elements. Different types of teeth 46 are provided for attachment to the diverging surfaces 24, 26 of the mouth. Further, noses 48, eyes 50, ears 52 and hairpieces 54 are provided for attachment to the rest of the head portion 12. Each component has a relatively stiff base 56 (FIG. 5) which is made of a hard vacuformed plastic, and a backing 58 formed of "Velcro" material. The components other than the teeth 46 are intended to be attached anywhere on the head portion 12 by engaging their "Velcro" backings 58 with the layer of polyester material 22 on the head portion. Similarly, each of the teeth 46 is designed for attachment to the mouth, by engaging its "Velcro" backing with one of the converging surfaces 24, 26. The base 20 of the head portion is formed of a urethane foam which is stiff enough so that no additional backing is needed to allow ready attachment of the facial components 16 to the layer of polyester material 22.

Figure 2:
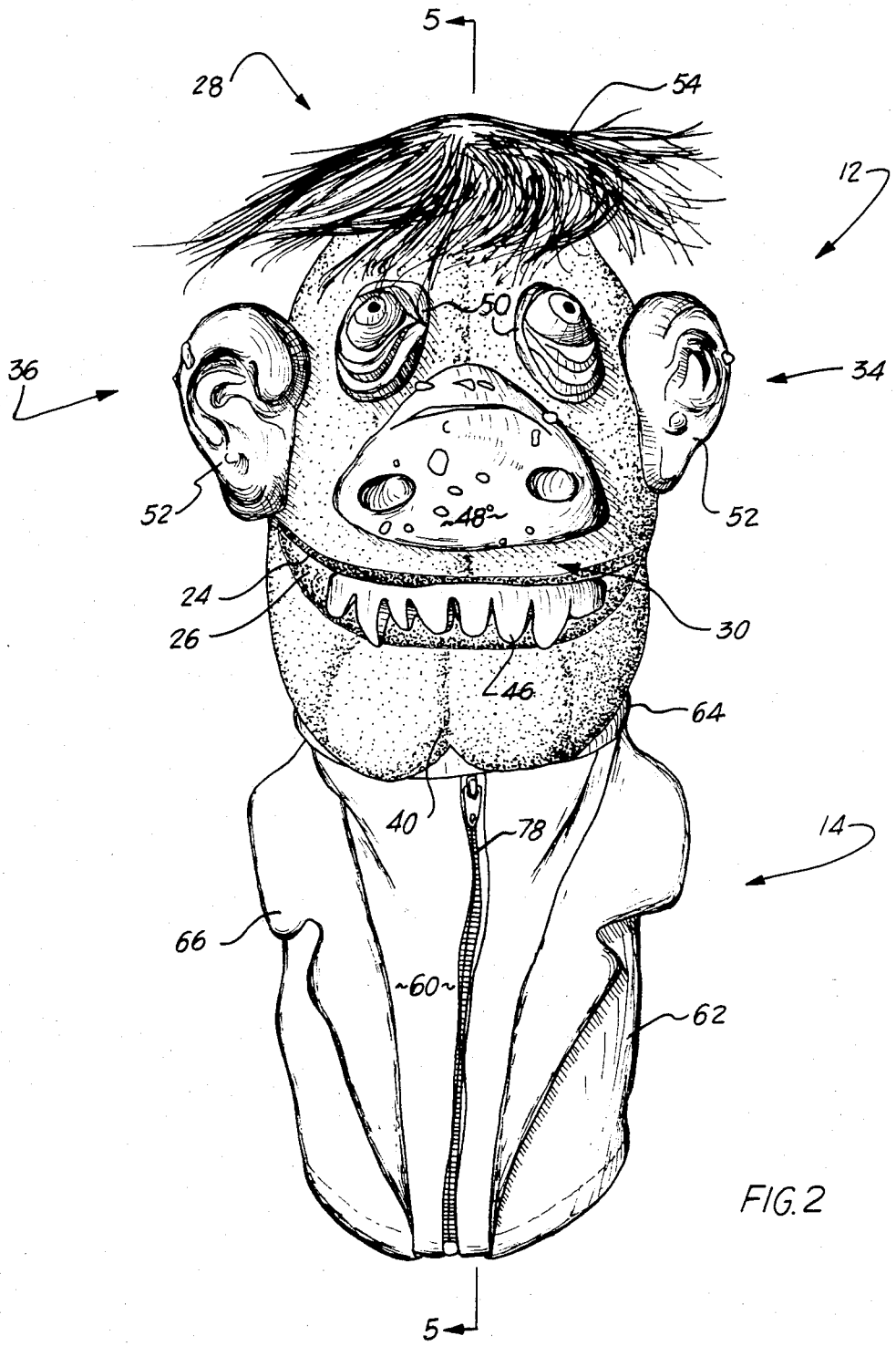
FIGS. 2 and 3 are perspective front views of some different hand puppets formed according to the invention.
Figure 3:
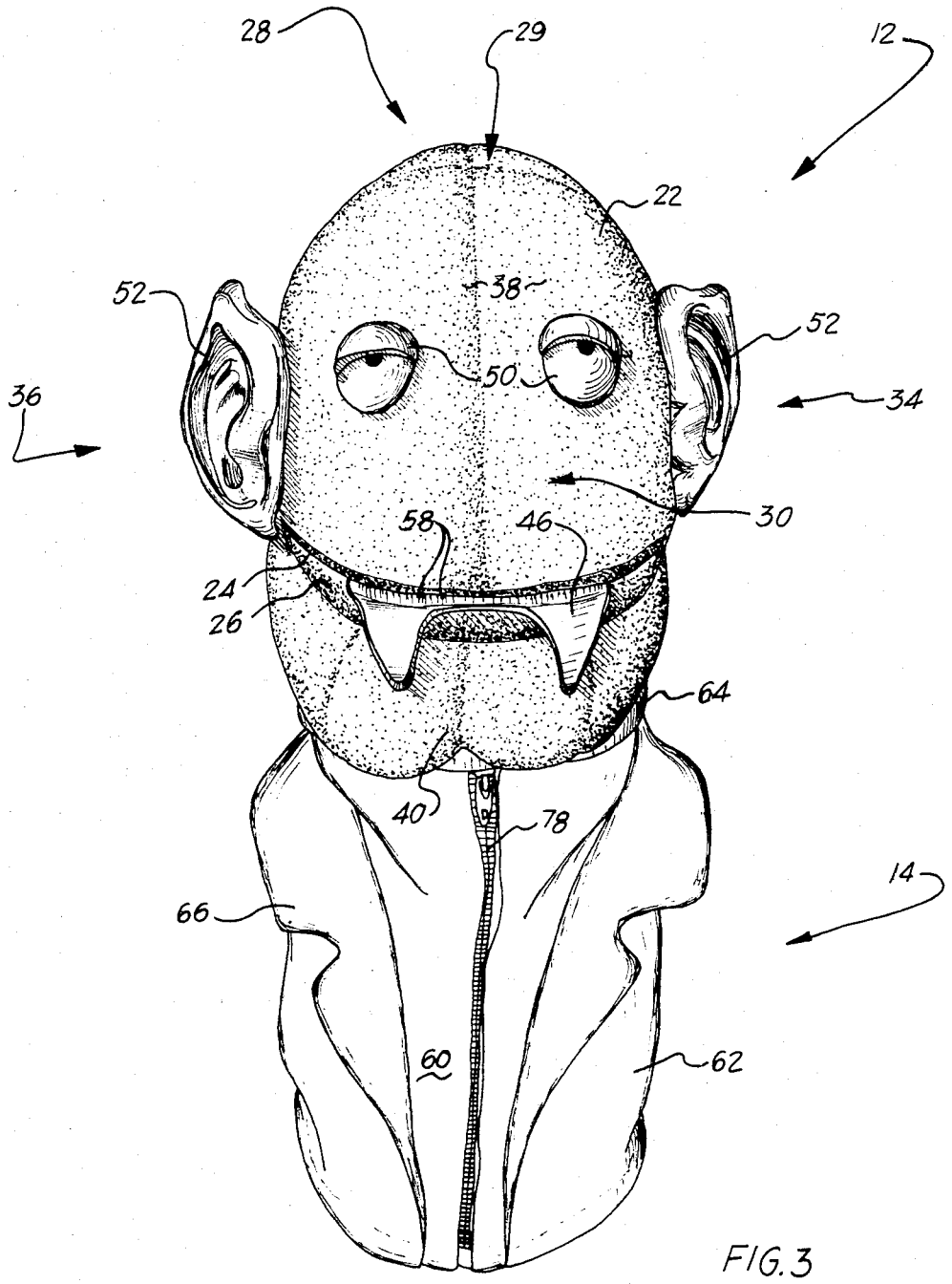
Figure 4:
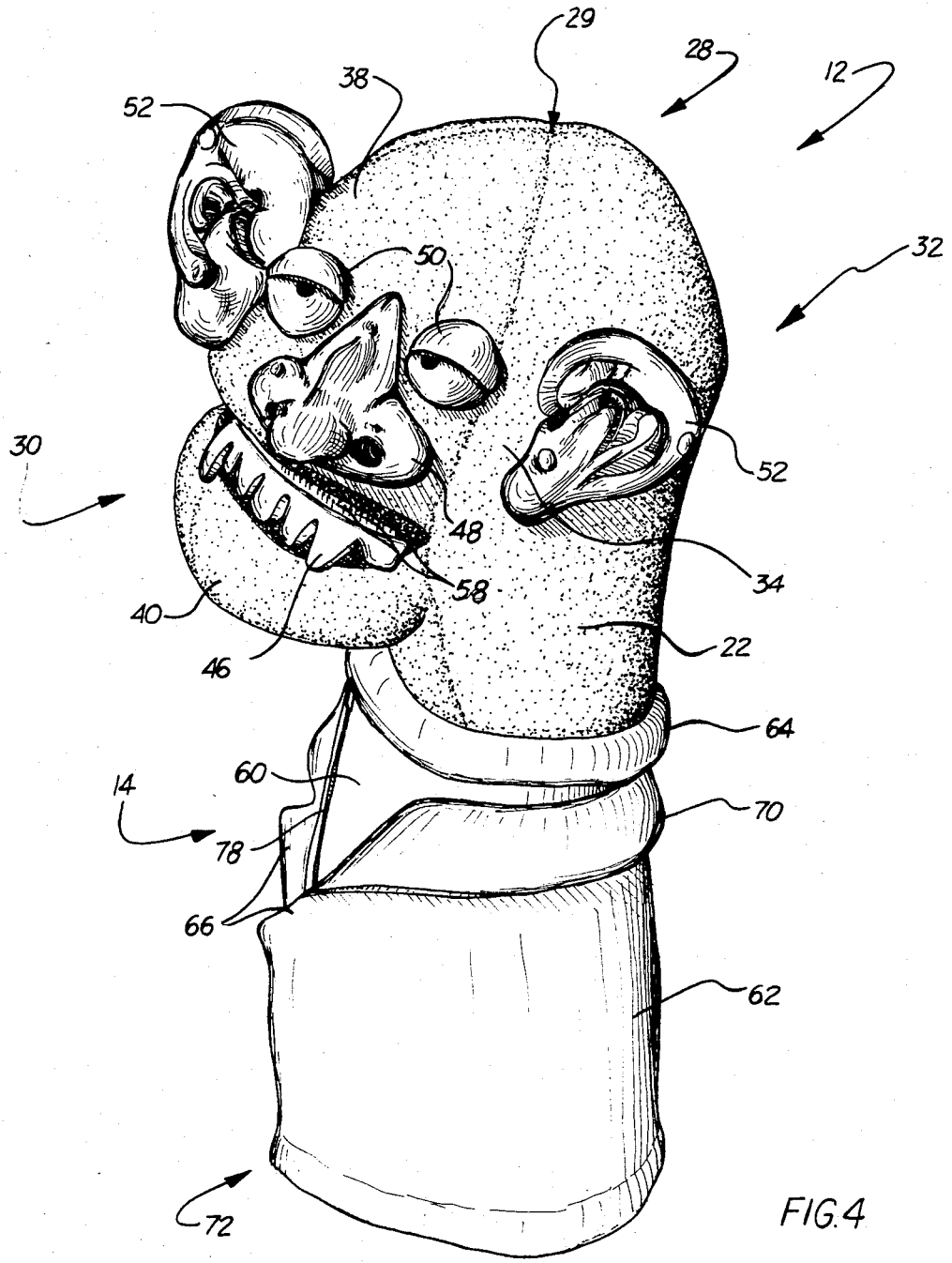
FIG. 4 is a perspective side view of yet another hand puppet formed according to the invention.

FIGS. 2, 3 and 4 show examples of hand puppets which can be made according to the principles of the invention. As seen from FIG. 2, the puppet may have teeth, eyes, ears, a nose and a hairpiece. As seen from FIG. 3, the puppet may have teeth, eyes and ears, but no nose or hair. As seen from FIG. 4, the puppet may have teeth, eyes, ears and a nose, but no hair. As further seen from FIG. 4, the puppet can have a distorted face by placing most, if not all, of the facial components, in unusual positions on the head portion.

As can well be imagined, the construction of the invention makes a whole host of possible characters available to a user. Each of the facial components can be placed in virtually any desired orientation on the head portion 12, and this further adds to the variety of characters which can be formed with a puppet according to the invention. Also, an unusual number of the same type of component can be attached to different points on the head portion. For example, more than two ears, or two eyes can be attached to the head portion 12 to either make the puppet more amusing, or to make the puppet look like a science fiction type character.

Figure 6:
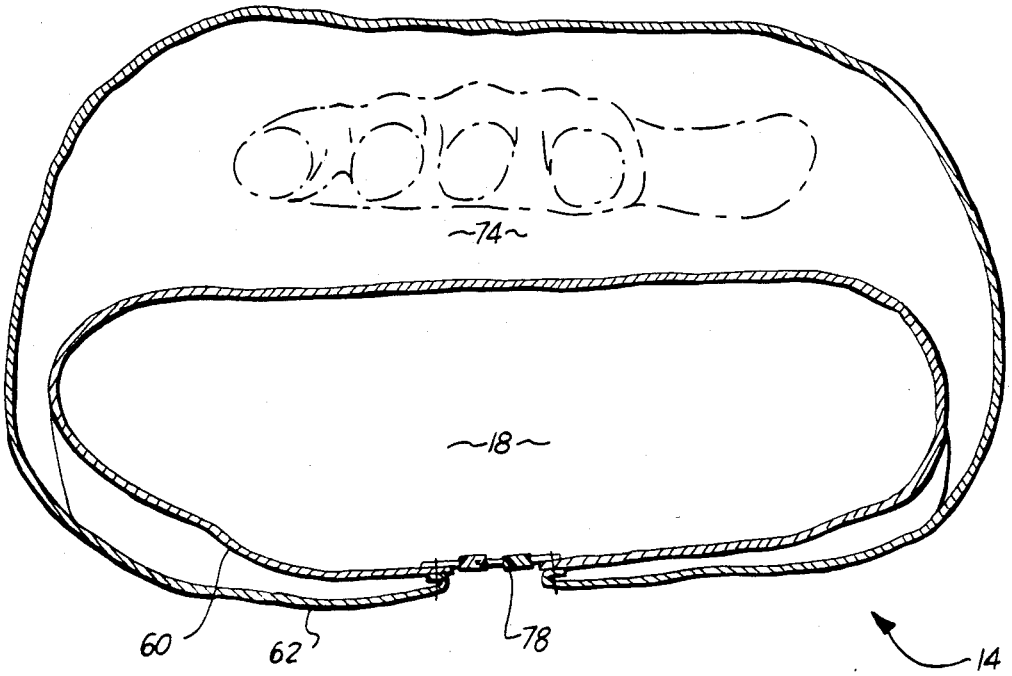
FIG. 6 is a sectional view of the puppet of FIG. 5, taken from the direction 6—6.

As shown in the drawings, the fabric sleeve 14 depends from the head portion 12. Referrring to FIGS. 5 and 6, the fabric sleeve 14 is formed of two pieces of fabric 60, 62. The piece of fabric 60 has a turtle-neck top with an annular collar-like portion 64 surrounding the flange 44 on base 20. The annular, collar-like portion 64 is secured to the flange 44 by means of staples, adhesive etc. Also, the layer of polyester material 22 could cover the flange 44, and the annular collar-like portion 64 could have a strip of "Velcro"-like material for detachable connection to the head portion. The other piece 62 of the fabric sleeve is formed of Velour-like material and depicts an outer jacket or garment with features such as lapels 66 and a collar 70. The pieces of fabric 60, 62 are fastened together at their bottom ends, as shown at 72 in FIG. 4, and also at other appropriate locations to form the remainder of the sleeve. Specifically, the sleeve is formed so that its distal end defines an opening 74, through which a person's hand can be inserted for supporting the puppet.

Additionally, the fabric sleeve 14 also includes the storage compartment 18 for the detachable facial components 16. The storage compartment 18 extends inward from the outer, visible part of the fabric sleeve (see FIG. 5). The storage compartment 18 has an access opening 76, and a closure (e.g., a zipper 78), for opening and closing the access opening 76. When it is closed, the zipper 78 itself forms part of the visible part of the puppet's outer garment (FIGS. 2, 3, 4).

All of the facial components 16 can be stored in the storage compartment 18. Thus, the puppet, including its components, can be readily stored, carried or shipped, without the need for a separate container to prevent loss of any of the facial components. In order to form the puppet, a person only has to remove some or all of the facial components, and decide which components to use to form the puppet's face. The components are then readily attached to the head portion, in any arrangement which the person desires. The remaining components are stored in the storage compartment, and can be used to change the puppet's face. The puppet's face can also be changed by simply rearranging the components which are already on the head portion. Since the components can be placed anywhere, and in any orientation on the head portion, a single set of facial components can be used to form different characters, by rearranging the location of the components on the head portion. In fact, although the head portion has what is defined above as a forehead area 38 and chin area 40, by orienting the components on the head portion as if the area 40 were the puppet's forehead and the area 38 were the puppet's chin, the puppet would appear to be a science fiction-type character with an upside-down head.

Thus, the invention is believed to provide a new and useful hand puppet for forming a number of different characters.

What is claimed is:

1. A hand puppet adapted to be formed into different characters, comprising a head portion; a plurality of facial components for detachable attachment to said head portion; a sleeve depending from said head portion; said sleeve defining an opening for receiving a person's arm for supporting the hand puppet therefrom; said sleeve including a storage compartment for storing said facial components; closure means for selectively opening and closing said storage compartment; said head portion having an outer peripheral surface defining a front portion, a top portion, a back portion and side portions extending between said front and back portions, said front portion of said outer surface having a recessed portion defining a mouth; a layer of a material which can engage "Velcro"-like material covering the portions of said outer surface defining said mouth and said front, top, back and side portions of said head portion, each of said detachable facial components including a layer of "Velcro"-like material for detachably engaging the component with any portion of said head portion in different locations on said head portion, and said detachable facial components including at least one set of teeth with a strip of "Velcro"-like material for detachable engagement to a part of said mouth.

2. A hand puppet as defined in claim 1 wherein said head area includes a relatively stiff base defining said outer peripheral surface.

3. A hand puppet as defined in claim 2 wherein said recess portion comprises a pair of surfaces which converge inwardly from said outer peripheral surface.

4. A hand puppet as defined in any of claims 1–3 wherein said sleeve has a visible outer periphery, said storage compartment extending inward from the visible outer periphery of said sleeve and being completely separated from the portion of the sleeve which receives a person's arm, means forming an access opening to said storage compartment, said closure means being adapted to open and close said access opening, and said storage compartment being hidden from view by the outer periphery of said sleeve when said closure means is closing said access opening.

5. A hand puppet as defined in claim 4 wherein said sleeve is formed of fabric, and has an outer periphery shaped to depict a garment for the puppet.

* * * * *